United States Patent [19]

Kolb

[11] Patent Number: 4,761,834

[45] Date of Patent: Aug. 9, 1988

[54] SYSTEM FOR FACILITATING PROTECTION OF AN ATHLETE'S HIP AND PELVIC AREA

[76] Inventor: Joseph J. Kolb, 4 Gilbert Ave., Smithtown, N.Y. 11787

[21] Appl. No.: 884,381

[22] Filed: Jul. 11, 1986

Related U.S. Application Data

[63] Continuation-in-part of Ser. No. 664,242, Oct. 24, 1984, abandoned.

[51] Int. Cl.[4] ..... A41D 13/00

[52] U.S. Cl. ..... 2/2; 2/267; 2/338; 2/DIG. 6

[58] Field of Search ..... 2/2, 267, 338, DIG. 6

[56] References Cited

U.S. PATENT DOCUMENTS

| | | | |
|---|---|---|---|
| 1,229,947 | 6/1917 | Haggerty | 2/2 |
| 1,740,171 | 12/1929 | Goldsmith | 2/2 |
| 1,756,358 | 4/1930 | Ingram | 2/2 |
| 1,774,739 | 9/1930 | Voyne | 2/2 |
| 1,786,268 | 12/1930 | Snavely | 2/2 |
| 3,921,222 | 11/1975 | Hollman | 2/2 |
| 4,370,754 | 2/1983 | Donzis | 2/2 |
| 4,472,839 | 9/1984 | Johansen | 2/338 |

OTHER PUBLICATIONS

"Journal of American Medical Assoc."; p. 930; 19, Oct. 1958; Dr. M. Gershman.

*Primary Examiner*—Louis K. Rimrodt

*Attorney, Agent, or Firm*—Hoffmann & Baron

[57] ABSTRACT

A hip and pad assembly for use in protecting the hip and pelvic areas of an athelete. At least one protective pad assembly is provided with a configuration facilitating its positioning over the hip and iliac crest area of the pelvis on a side of a user. An elongated thin lightweight belt is provided with an elastic portion and Velcro type hook and eyelet fasteners with mating fastener elements at the free ends of the belt. The belt and the pad assembly are removably coupled in a manner which facilitates relative sliding movement therebetween. The Velcro type hook and eyelet fasteners are dimensioned to permit attachment between the mating fastener elements thereof over a range of points thereby making the assembly adjustable to fit a variety of different size athletes and to be quickly and efficiently put on or removed by the athlete before, during and subsequent to the athletic event. The elasticity of the belt and the capability of the pad assembly to move relative to the attached belt facilitates comfortable use by the athlete while accommodating a variety of different athletic movements.

22 Claims, 4 Drawing Sheets

FIG. 6
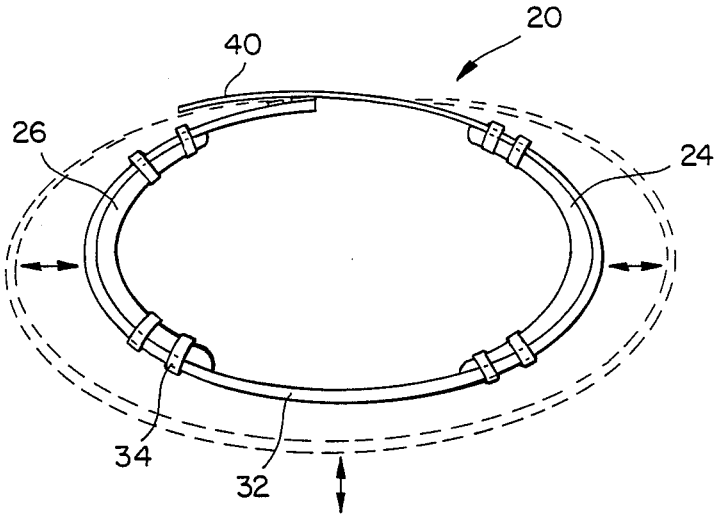
FIG. 8
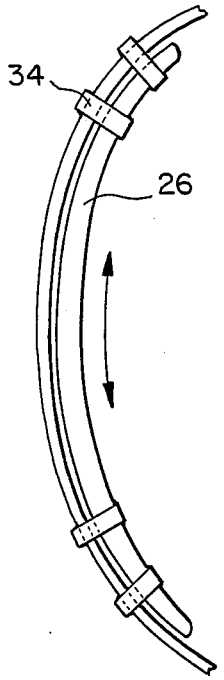
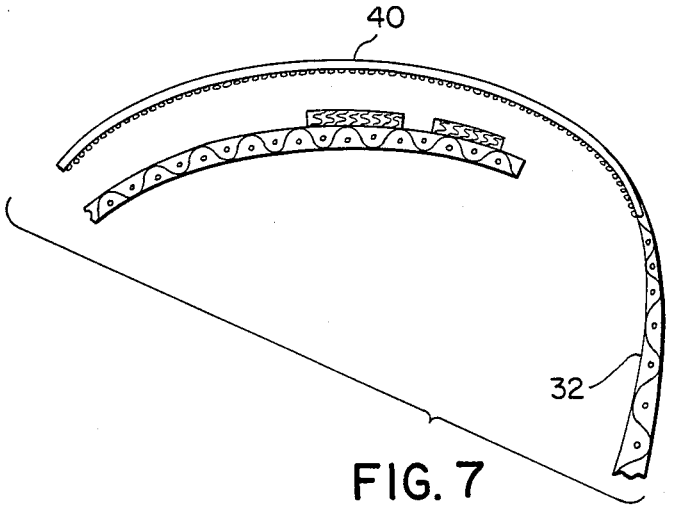
FIG. 7

SYSTEM FOR FACILITATING PROTECTION OF AN ATHLETE'S HIP AND PELVIC AREA

This application is a continuation-in-part of U.S. patent application Ser. No. 664,242 filed on Oct. 24, 1984, now abandoned.

BACKGROUND OF THE INVENTION

Coincident with athletics is body contact either with other participants or with a hard surface such as the ground or a floor. Consequently, many different types of protective pads have been developed and used for many years to shield anatomical portions of the participant during an athletic event.

Often the type of padding depends on the portion of the participant's anatomy that is subjected to anticipated blows. For example, the type of padding required by a football player varies from that required by a hockey player, a soccer player, a volleyball player or a baseball player. Thus, historically, a wide range and sequence of designs in protective pads has evolved over many years in connection with athletic environments. The earlier designs were rather crude such as those employed in the United States at the turn of the century and, of course, the modern constructions are considerably more complex.

Certain types of sports have required more extensive padding such as football where there is severe body and ground contact during the entire game. Other sports such as baseball have required lesser padding with baseball predominantly being concerned with sliding pads.

Naturally, there are certain portions of the athlete which required protection most often, for example, the head, the shoulders, the hip, pelvic and kidney areas, the chest, and the elbows. Accordingly, quite diverse padding arrangements have been developed over the years for these and other areas of the body.

Protection, of course, is the primary concern. However the padding must be such that it provides for minimum discomfort to the athlete while providing minimum interference with the athlete's flow of action in carrying out the athlete endeavors. Also of concern is ease of application and removal of the padding, both prior to and subsequent to the athletic event without producing undesirable displacement or loss of the pads during the action sequences. Thus, various types of elastic portions are provided in conjunction with different types of padding and many types of fastener elements are employed, such as belts with buckles, lacing and in connection with more recent products, fasteners of the Velcro type.

There are certain sports where better protective padding arrangements and assemblies are still desirable and have not been satisfactorily developed. For example, volleyball is one of those sports. In particular, the hip and pelvic areas is subjected to severe punishment primarily due to floor contact during the volleyball events. Effective volleyball padding has not been available particularly padding which can be quickly and effectively put on by the athlete largely independent of the size of the athlete and adjusted to accommodate the athlete's movement during the volleyball action while consistently protecting the hip and pelvic area. Since playing conditions often change as well as the player's position and activity in the game, it is often desirable to quickly and efficiently remove pads and at particular points in time during the action. Accordingly, there is a need for an effective hip pad assembly that can be used by the volleyball player at different times during the action of the game without having to retire to the dressing room or the sidelines to put on or remove the pads.

In summary, it is apparent from the types of pads available in the marketplace that a variety of different types of protective athletic pads have been developed over the years to protect various portions of the body including the hip area. However, it is clear that there is still room for improvement in hip pad design in order to accomplish the above results, particularly in connection with sports such as volleyball or soccer.

SUMMARY OF THE INVENTION

With the above background in mind, it is among the primary objectives of the present invention to provide a protective hip pad system for use by athletes in protecting the hip and pelvic area of the athlete during the athletic endeavor.

It is an object of the invention to provide a protective hip pad system which is adaptable for use particularly in sports such as volleyball and soccer to protect the hip and pelvic areas, particularly the iliac crest of the pelvis and greater trochanter.

It is a further objective of the present invention to provide a hip pad system wherein the hip pad assembly is designed to be quickly and efficiently put on and removed by the athlete either before, during or after the athletic event.

A still further objective of the present invention is to provide a hip pad system in which the pads are designed to be adjustable to fit a variety of different size and shape athletes and to accommodate a variety of different types of movements of the athlete during use without interference with the athlete's movements.

It is still a further objective of the present invention to provide a protective hip pad system which is shiftable by the athlete and adjustable to cover any sensitive area in respect to the hip and pelvis region. The system is designed with a belt portion normally designed to cover the iliac crest portion of the pelvis and depending pads which are positioned to cover the greater trochanter of the femur on each side of the wearer.

It is a further objective of the present invention to provide a hip pad system in which the pads are formed with at least one and, preferably a pair of T-shaped pad portions attached to an elastic belt. Each pad assembly is permitted relative movement with respect to the belt to facilitate adjustability to accommodate different size wearers and different movements by the wearers. Additionally, each pad assembly includes an iliac pad and a trochanter pad with the iliac pad arranged horizontally and the trochanter pad removably attached thereto and depending therefrom. The trochanter pad includes a trochanter adjustment strap for removable attachment to the iliac pad and to permit relative vertical and horizontal adjustment of the trochanter pad relative to the iliac pad and the belt.

Additionally, Velcro fastener means in form of Velcro type hook and eyelet fastener elements is provided to permit quick and efficient attachment and detachment of the free ends of the belt to facilitate fastening and removal of the hip pad assembly by the wearer and also to facilitate fastening and removal of the trochanter pad with respect to the iliac pad and belt. Velcro type fastener means on the belt permits attachment over a wide variety of points along the length of the belt thereby providing for adjustability of the length of the belt portion of the assembly for size considerations. Furthermore, the Velcro type fastener means is designed so that one or both fastener portions thereof is of reduced diameter to facilitate bending action of the athlete during use.

It is also a further objective of the present invention to provide a pad design of minimum thickness while retaining maximum protective capability. For example, a pad of approximately ¼ to ⅜ of an inch in thickness has been found to be effective for use as part of the assembly.

Among the objectives of the present invention is to provide a hip pad assembly for use in protecting the hip and pelvic areas of an athlete in which the assembly includes at least one of a pair of T-shaped hip pads with the horizontally extending part containing a plurality of spaced parallel loops through which an elastic belt is passed. A depending vertical part of each hip pad extends downward from the intermediate portion of the horizontal part and attached belt. The belt is elastic to facilitate movement and is dimensioned so that it is smaller than the loops to provide relative movement between the belt and pads, thus again facilitating movement and fitting of the assembly to the athlete.

It is also contemplated that each T-shaped pad be formed of two separate attachable pad elements, the horizontal portion forming an iliac pad and the vertical portion forming a trochanter pad. The trochanter pad is attached to the iliac pad by means of a trochanter adjustment strap which is of sufficient length to extend around the iliac pad and attached belt until mating Velcro type fastener strips on the trochanter straps and trochanter pad interengage. The trochanter strap is provided with sufficient length so that the trochanter is slidable along the iliac pad to permit relative horizontal adjustment between the iliac pad, the belt and trochanter. Additionally, the Velcro type fasteners strips on the trochanter strap and the trochanter pad are dimensioned sufficiently to permit vertical adjustment of the trochanter pad relative to the iliac pad and belt depending upon which portions of the Velcro type fasteners strips on the trochanter strap and pad are attached.

It is also contemplated that the belt include a Velcro fastener means with a pair of Velcro fastener elements. The elements are designed so that one is elongated with respect to the other to provide for a plurality of different attachment points, thus providing for the increase and decrease in length of the attached belt as desired to fit the particular user. The Velcro fastener means provides for quick and efficient attachment and detachment at any time either before, during or after the athletic event.

It should also be noted that the Velcro fastener elements can be formed of reduced width to make the assembly more adaptable and permit more freedom of the athlete particularly in bending types of actions.

In general, the hip pad assembly is adapted to be easily shiftable to cover any sensitive area in the hip and pelvic region and to be quickly and easily attached and detached to an athlete either prior to, during or subsequent to use in an athletic event. The pads are quite useful in a variety of different sporting events in which the hip and pelvic areas are subjected to body contact or contact with hard surfaces. For example, volleyball and soccer are sports within this category.

In summary, a hip pad assembly is provided for use by athletes in protecting the hip and pelvic areas of an athlete. The assembly includes at least one thin, lightweight protective pad assembly having a configuration facilitating its positioning over the hip and iliac crest area of the pelvis on a side of the user. An elongated thin lightweight belt width is provided with an elastic portion and Velcro type fastener means having mating fastener elements at the free ends of the belt. Attachments means is provided from removably coupling the belt and pad assembly in a manner that facilitates relative sliding movement therebetween. The Velcro type fastener means is dimensioned to permit attachment between the mating fastener elements thereof over a range of points thereby making the assembly adjustable to fit a variety of different size athletes and to be quickly and efficiently put on or removed by the athlete before, during and subsequent to the athletic event. The elasticity of the belt and the capability of the pad assembly to move relative to the attached belt facilitates comfortable use of the athlete while accommodating a variety of different athletic movements.

With the above objectives among others in mind, reference is made to the attached drawings.

BRIEF DESCRIPTION OF THE DRAWING

In the drawing:

FIG. 6 is a top plan view of the hip pad assembly of FIG. 3 with the free ends attached with an alternative configuration shown in phantom upon expansion of the elastic belt portion of the assembly;

FIG. 7 is a fragmentary top sectional view of the assembly of FIG. 3 showing the free end portions and the adjustable points of attachment thereof;

FIG. 8 is a fragmentary top plan view of the hip pad assembly of FIG. 3 showing the attachment between the belt portion and one of the pads of the assembly;

DETAILED DESCRIPTION

Figure 1:
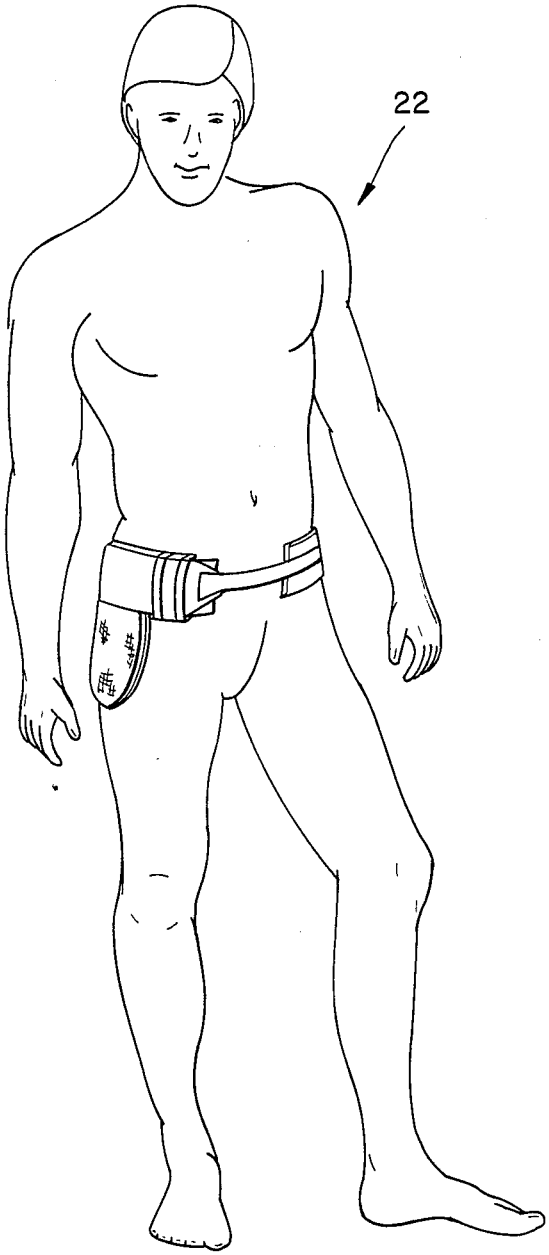
FIG. 1 is a front perspective view of an athlete wearing the hip assembly of the invention.
Figure 2:
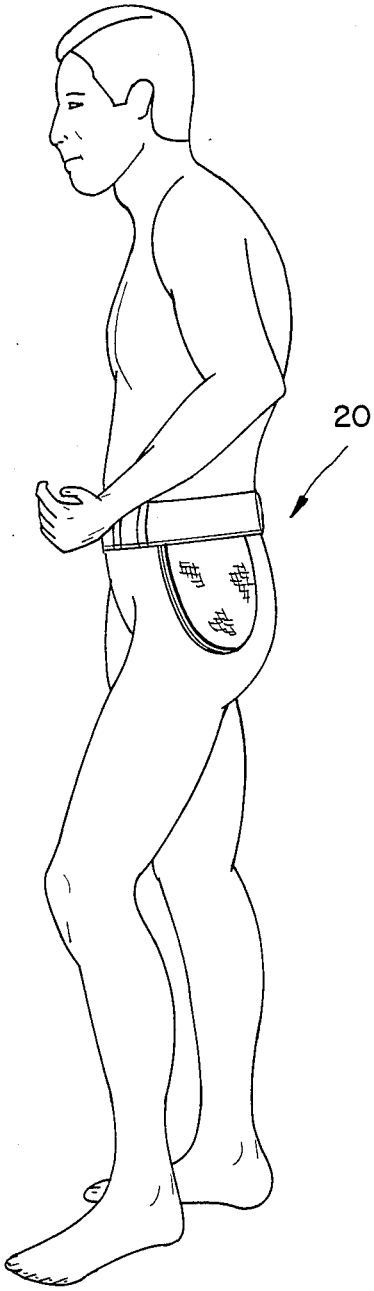
FIG. 2 is a side perspective view of the athlete wearing the hip pad assembly of the invention.

Hip pad assembly 20 is depicted in FIGS. 1 and 2 in position on an athlete 22, As shown, the assembly 20 is designed to cover the hip and pelvic areas of athlete 22 and, particularly, to protect the iliac crest of the pelvis and the greater trochanter of the femur. The depending pad portion is generally positioned over the femur and the horizontally extending pad portion attached to the belt is generally positioned over the iliac crest of the pelvis. However, the assembly 20 is adjustable and easily shiftable between positions to cover any desired sensitive areas at the location of the hips and pelvis.

Figure 3:
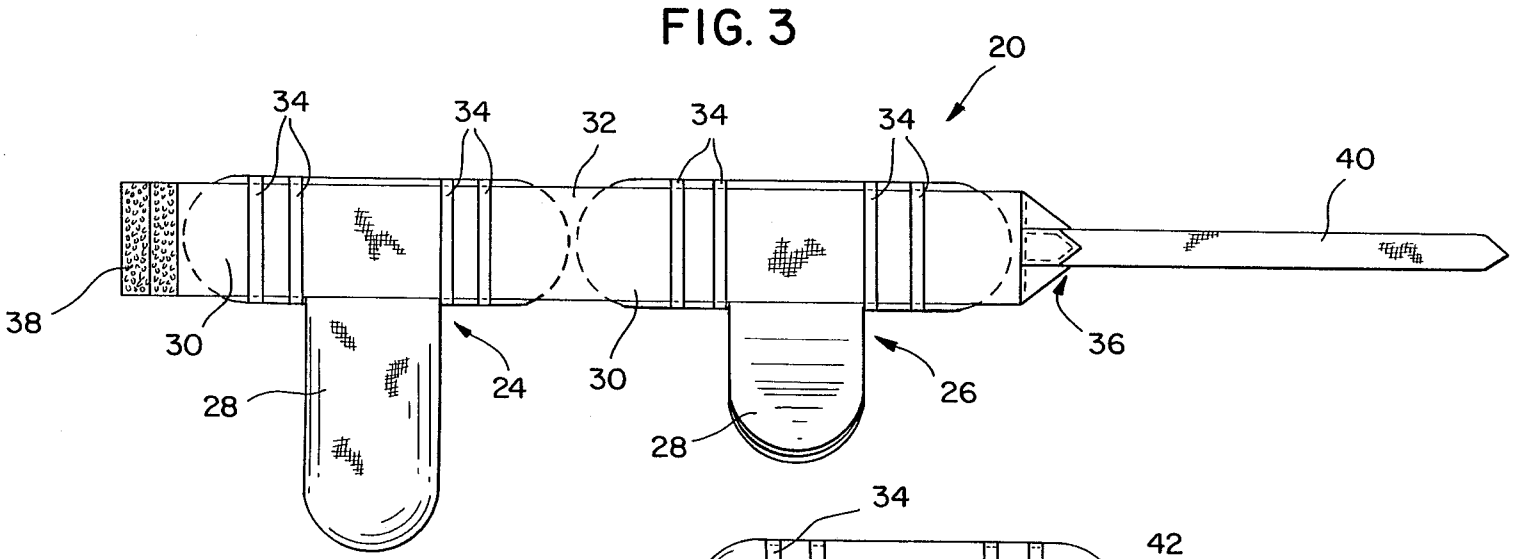
FIG. 3 is a side elevation view of the hip pad assembly of the invention with the free ends unattached.

The elements of assembly 20 are depicted in assembled form in FIG. 3. Included are a pair of T-shaped pads 24 and 26 having substantially the same configuration and size. Thus, each pad includes a vertically depending part 28 and a horizontally extending part 30.

The pads are separately mounted and affixed to a belt 32. The majority of the length of belt 32 is formed of elastic material to facilitate its adjustability and shiftability. In the embodiment depicted in FIGS. 1–8, the majority of belt 32 is formed of elastic material, however, it is possible that selected portions of the belt can be elastic with the remainder relatively inelastic according to a matter of choice. As shown by the arrows, the elastic belt can be considerably expanded, and due to its elasticity, is designed to fit a variety of different size athletes.

Attachment between pads 24 and 26 and belt 32 is facilitated by a plurality of spaced parallel loops 34 positioned at predetermined points along the length of a horizontal pad 30, which can be designated the iliac pad in view of the area of the body it normally covers. Similarly, the vertically depending pad 28 can be designated as the trochanter pad in view of the area of the body which it is primarily designed to protect.

The loops 34 can be sewn to iliac pad 30 or otherwise affixed in a conventional manner. The loops are arranged in pairs as shown and are slightly larger than the diameter and width of belt 32 so that the belt can freely pass through the loops thus affixing the pads to the belt while permitting sliding movement of the pad assemblies relative to the belt and slight vertical shifting therebetween to facilitate adjustment and positioning of the pads on the athlete's body when hip pad assembly is applied to the athlete.

Thus, there are four loops for attachment of each pad assembly and, accordingly, eight loops in all with respect to the two assemblies. The number of loops is obviously a matter of choice as long as there are sufficient loops to achieve positive attachment between the pad assembly and the belt.

Alternative attachment means is available to those skilled in the art as long as the desired relative movement is permitted between the pad assembly and the belt to provide for the adjustability of the assembly and adaptability to a wide variety of size athletes and athletic movements. The relative sliding movement and the elasticity of the belt provides the user with a great deal of freedom of movement, which is certainly desirable to an athlete.

It should also be kept in mind that it is not necessary for the athlete to apply both pad assemblies to the belt upon use. If he finds it desirable, only one pad assembly may be used to protect one side of the athlete while the other side is left unprotected should protection be deemed unnecessary or unwanted on that side.

Velcro type hook and eyelet fastener means is mounted to the free ends of belt 32 with one of the Velcro type fastener elements 36 extending from one free end of the belt and the other Velcro type fastener element 38 affixed to the other free end of the belt. As shown, Velcro type fastener element 38 has substantially the same width as belt 32 while element 36 has a reduced diameter elongated tongue portion 40. Tongue portion 40 is designed to mate with portion 38 and, since it is elongated relative to portion 38, attachment can occur over a variety of points along the length of tongue 40, thus providing for and adjustment of the belt to a wide variety of sizes. Additionally, the narrow diameter or width of tongue 40 permits freedom of movement of the athlete in that it provides limited restriction to bending type movements.

Furthermore, the tongue 40 can be attached to various points of portion 38 across its width thus providing for an additional adjustment feature for the hip pad assembly relative to the athlete.

Figure 4:
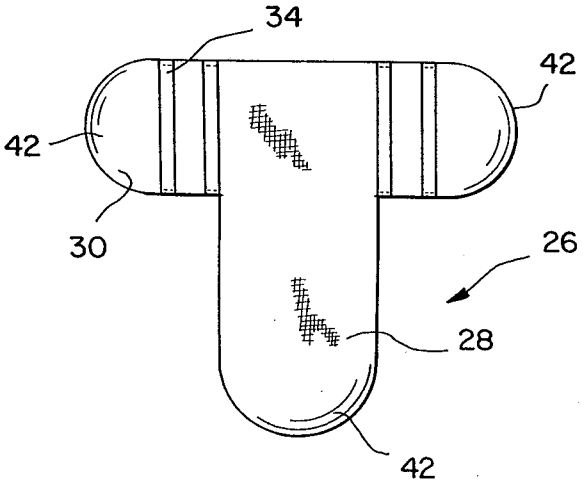
FIG. 4 is a side elevation view of one of the pads of the assembly of FIG. 3.

The details of each pad, such as pad 26 is depicted in FIG. 4. The depending vertical portion or trochanter pad 28 and the ends of the horizontal portion of iliac pad 30 are provided with rounded ends 42 for protective purposes and the padding material is chosen from any one of a number of different conventional lightweight pad materials known in the market today, for example foam rubber or plastic or any conventional well known substitute therefor. However, the padding should be relatively thin to thereby limit the weight and bulk, and accordingly, interference with the athlete's movements, but shall afford the desired amount of protection as well. It has been found effective to provide pads which are in the range of approximately $\frac{1}{4}$ to $\frac{3}{8}$ of an inch thick. The loops 34 can be formed of a conventional cloth material and may be elastic or inelastic. As stated above they can be sewn or otherwise conventionally fastened to iliac pad 30. If desired, it is also possible to affix the loops 34 to trochanter pad 42 as long as secure pad assembly and belt attachment can be achieved.

Belt 32 is also formed of a conventional material commonly used in the protective athletic padding field and, as stated above, can be partially or entirely elastic along its length.

Figure 5:
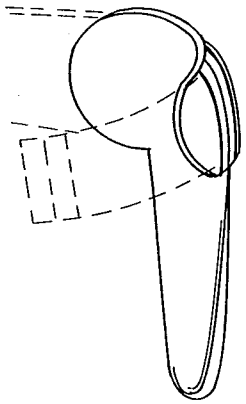
FIG. 5, is and end elevation view of the pad of FIG. 4 showing the belt attached thereto in phantom.
Figure 9:
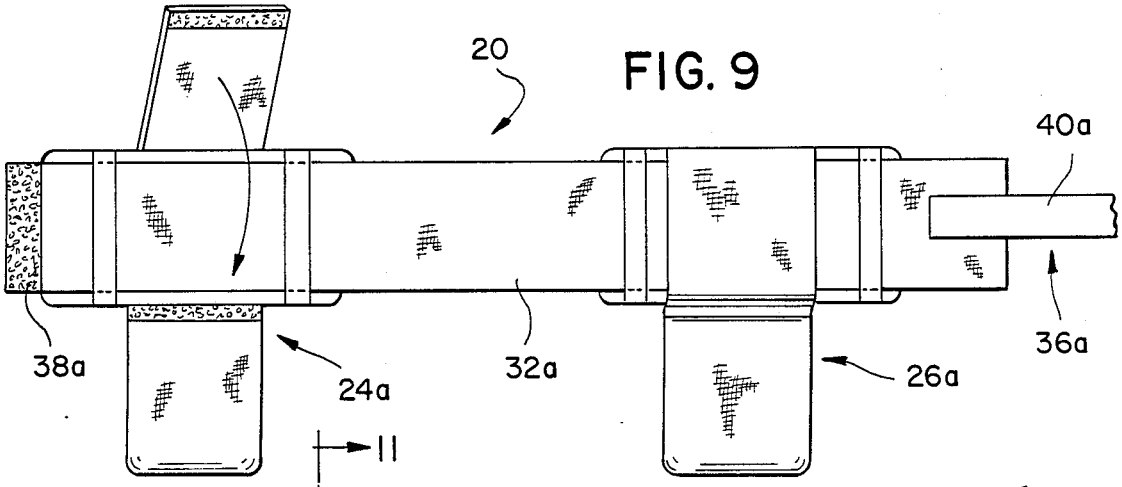
FIG. 9 is a side elevation view of an alternative embodiment of the hip pad assembly of the invention with an arrow showing the direction of attachment for one of the trochanter pads.

In FIG. 5 it can be seen how clearance is provided between belt 32 and loops 34 so that relative sliding movement is obtained between the pads and the belt. It can also be seen from FIG. 5 that the pads are flexible in nature to conform to the arcuate shape of the athlete's hip and pelvic areas, particularly when clothing is applied over the pads. FIGS. 1 and 2 also demonstrate this capability of the pad assembly.

The adjustability and shiftability of the hip pad assembly 20 is further demonstrated in FIGS. 6–8. Since tongue 40 is elongated, the size of the circumference of the assembly to accommodate different size athletes can be seen in FIG. 6. In solid lines, the belt is attached at a point of predetermined diameter and of predetermined circumferential length. In phantom, the belt is shown elastically expanded, either due to the size or movement of the athlete. Attachment can be achieved at virtually an infinite number of points of connection between tongue 40 and fastener element 38. This is possible due to the Velcro type fastener means and, in particular, the length of the Velcro type fastener element of tongue 40. Thus, the relative lengths of tongue 40 and mating Velcro type fastener element 38 participate in determining the parameters of the diameter and circumference of the assembly. Further adjustment in a transverse position is obtainable due to the relative widths of tongue 40 and Velcro type fastener elements 38. Canting of the belt is facilitated by adjusting the engagement position of tongue 40 with respect to different points on the width of element 38.

FIG. 8 shows the manner in which each pad assembly for example, pad assembly 26 is slidable relative to belt 32 along an arcuate path due to the elasticity of belt 32 and the clearance between the pad belt 32 and loops 34. Freedom of movement is provided in reciprocal directions in this respect as indicated by the arrows in FIG. 8.

The multiplicity of points of attachment of the Velcro type fastener means is depicted in detail in FIG. 7 of the drawings. The variety of points of attachment is limited only by the chosen length for tongue 40 and size, number and length of mating Velcro type fastener elements 38.

An alternative embodiment of the hip pad assembly 20 depicted in FIGS. 9–12. Similar components to those in the embodiment of FIGS. 1–8 have been given similar numbers with the addition of subscript "a". Thus, hip pad assembly 20*a* includes pad assembly 24*a* and 26*a* which are removably attached to belt 32*a*. Belt 32*a* includes an elastic portion and a reduced diameter Velcro type fastener element 36*a* at one end and a mating Velcro type fastener element 38*a* at the other free end. Velcro type fastener element 36*a* includes a reduced diameter portion 40*a*. In this matter, releasable attachment of the belt is achieved along with the appropriate adjustment capabilities as discussed above. It should be kept in mind that both of the embodiments 20 and 20*a* can be modified appropriately to facilitate adjustment needs. For example, Velcro type fastener element 38*a* can be reduced and Velcro type fastener 36*a* can be made to extend the full width of belt 32*a*. Also, both Velcro type fastener 36*a* and 38*a* can be formed of the same width which also holds true for Velcro type fastener elements 36 and 38 of hip pad assembly 20.

Figure 10:
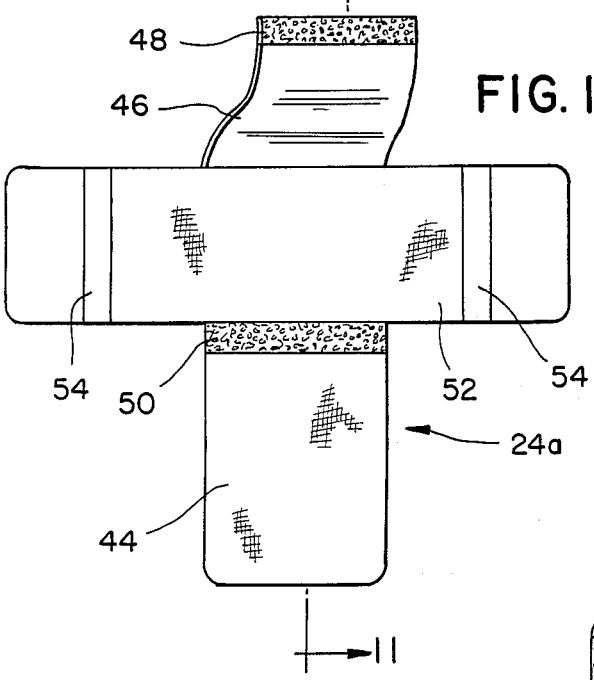
FIG. 10 is a side elevation view of a pad assembly portion of the alternative embodiment of FIG. 9 with the trochanter pad unattached.
Figure 11:
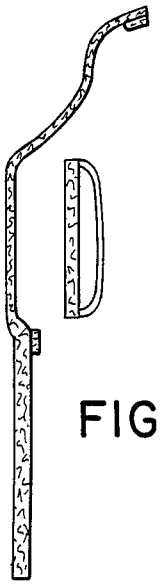
FIG. 11 is a sectional end view thereof taken along the plain of line 11—11 of FIG. 10.
Figure 12:
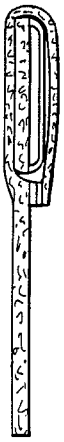
FIG. 12 is a sectional end view thereof with the trochanter pad attached.

Pad assembly 24*a* and 26*a* are identical and, in FIGS. 10–12, the details of pad assembly 24*a* can be easily seen. Instead of forming iliac pad 30 and trochanter 28 as an integral single piece of pad material T-shaped configuration, the T-shape of pad assembly 24 is formed by two separate pieces of pad material which are releasably attached. Vertically depending trochanter pad 44 includes a trochanter adjustment strap 46 extending from its upper edge. The strap 46 is of flexible material such as a cloth material. The free end of the strap 46 has a strip of Velcro type hook and eyelet fastener material 48 affixed thereto. The upper end of trochanter pad 44 has a mating strip of Velcro type fastener material 50 positioned thereon. Mating interengagement of strips 48 and 50 will form an attachment loop on trochanter 46.

Horizontally extending iliac pad 52 is formed of conventional padding material such as that used in the embodiment of hip pad assembly 20. It contains a pair of spaced loops 54 positioned thereon and attached in a conventional manner such as by sewing the loops to the pad 52. The loops are large enough to permit free extension therethrough of belt 32*a* and provide for the sliding movement of iliac pad 52 with respect to the belt. The loops are made large enough so that slight vertical adjustment is also achieved between the belt 32*a* and pad 52.

Trochanter pad 44 is releasability attached to iliac pad 52 by extending trochanter strap 46 around the central portion of pad 52 and attaching strip 48 to fastener strip 50. the loop formed by strap 46 is large enough to permit the free sliding movement of belt 32*a* and attached iliac pad 52 therethrough. Accordingly, the belt 32*a*, the iliac pad 52 and the trochanter pad 44 can be relatively adjusted with respect to one another. Additionally, by being able to easily remove trochanter pad 44 from iliac pad 52 by unfastening the Velcro type fastener strips 48 and 50, the athlete is able to use the hip pad assembly 20*a* with or without the trochanter pad 44. Again, the Velcro fasteners for the belt 32*a* and the pad assemblies 24*a* and 26*a* permit ease of attachment and detachment by the athlete at any time. As with the embodiment of hip pad assembly 20, the thickness of the pads is a matter of choice, but it has been found effective to use pad thickness in the range $\frac{1}{4}$ to $\frac{3}{8}$ of an inch.

As shown in FIGS. 11 and 12, pad assembly 24*a* accomplished in a quick and efficient matter, iliac pad 52 is inserted adjacent the upper end of trochanter pad 44 so that together they form a T-shaped configuration. Strap 44 is then extended about iliac pad 52 until strips 48 and 50 interengage to hold pad assembly 24A together. The completely assembled form is depicted in FIG. 12 and shows the matter in which iliac pad 52 and trochanter 44 can be slidably adjusted with respect to one another.

The size of the pad assemblies 24, 24*a*, 26, and 28*a* is a matter of choice depending upon the use of the pads and the size of the athlete. If desired, it is possible to cover the pad material with a lightweight canvas to increase the wear longevity of the hip pad assembly and to enhance the comfort for the athlete during use. All ends of the pads are rounded to avoid sharp edges.

In the above, manner it can be readily seen how the present hip pad assembly is quire versatile in regard to protective use by a variety of different size and shaped athletes. The pads can be quickly and easily put on by the athlete either prior to, during or after the athletic event. Thus, at any time the athlete can decide if he needs of does not need the pads and make the appropriate change of equipment without any material delay. All that is required is fastening or unfastening of the Velcro type fastener elements at the selected attachment points The elasticity and shiftability of the pads and belt arrangement accommodate the size and movement requirements of the athlete. The type of pads depicted in the present drawings are quite useful for volleyball participants. However, it can be readily envisioned how the same pads can be equally as useful for soccer players and other athletes as well.

Thus, the several of aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A hip pad assembly for use in protecting the hip an pelvic area of an athlete, comprising: A pair of thin, lightweight resilient protective pad assemblies and a configuration facilitating positioning over the hip and iliac crest area of the pelvis of the user, the pad assemblies being separate and adapted to be simultaneously positioned on the hips on both sides of the user respectively, each pad assembly being substantially T-shaped in configuration and including a horizontally extending iliac pad in a substantially vertically extending trochanter pad depending intermediate the ends of the iliac pad, an elongated, thin lightweight belt having an elastic portion and Velcro type fastener means having mating fastener elements at the free ends of the belt to form attachment means for coupling the belt and pad assembly in a manner that facilitates relative sliding movement therebetween, the Velcro fastener means being dimensioned to permit attachment between the mating fastener elements thereof over a range of points thereby making the assembly adjustable to fit a variety of different size athletes and to be quickly and efficiently put on or removed by the athlete before, during and subsequent to the athletic event, the elasticity of the belt and the capability of the pad assemblies to move relative to the attached belt and each other facilitating comfortable use by the athlete while accommodating a variety of different athletic movements, attachment means including each pad having a series of receiver elements affixed thereto through which the belt extends and the belt being sufficiently smaller in cross section than the receiver elements so as to permit relative or sliding movement therebetween, and the iliac pad having as predetermined configuration and size to be positioned to cover and protect the iliac crest of the pelvis while the trochanter pad is positioned to cover and protect the head of the femur.

2. The invention in accordance with claim 1 wherein one fastener element of the Velcro fastener means being an elongated strip extending form one free end of the belt and the mating fastener element being on the other free end of the belt whereby attachment of the elongated strip of the one fastener element to the mating fastener element at different points along the length of the one fastener element provides for adjustment of the length of the circumference and diameter of the hip pad assembly.

3. The invention in accordance with claim 2 wherein one of the fastener elements of said Velcro type fastener means being narrower than the mating fastener elements so as to increase the adjustability of the assembly by providing for transverse adjustment as well as circumferential adjustment.

4. The invention in accordance with claim 1 wherein the attachment means includes each pad having a series of loops affixed thereto through which the belt extends and the belt being sufficiently smaller in cross-section than loops so as to prevent relative sliding movement therebetween.

5. The invention in accordance with claim 1 wherein there are two pad assemblies, one for each hip of the user, each pad assembly is substantially T-shaped in configuration and includes a horizontally extending iliac pad and a substantially vertically extending trochanter pad depending intermediate in the ends of the iliac pad, and the loops being affixed to the iliac pad and being in spaced parallel relationship to one another, and the iliac pad having a predetermined configuration and size to be positioned to cover and protect the iliac crest of the pelvis while the trochanter pad is positioned to cover and protect the head of the femur.

6. The invention in accordance with claim 5 wherein the trochanter pad is removably attached to the iliac pad.

7. The invention in accordance with claim 6 wherein the trochanter pad includes a trochanter adjustment strap extending from one end thereof, mating Velcro fastener means on the free end of the trochanter adjustment strap and the trochanter pad so that when the trochanter adjustment strap is positioned around the iliac pad and the Velcro type fasteners elements are interengaged, the trochanter pad will be attached to the iliac pad and together form a T-shaped configuration, the trochanter adjustment strap having a predetermined length and the Velcro type fastener elements on the trochanter strap and the trochanter pad being dimensioned so as to prevent vertical adjustment of the trochanter pad with respect to the iliac pad and to provide freedom of movement between the iliac pad, the trochanter pad and the belt.

8. The invention in accordance with claim 1 wherein release of the Velcro type fastener means on the trochanter adjustment strap and the trochanter pad will permit removal of the trochanter pad from the iliac pad and the iliac pad being capable of use independent of the trochanter pad as a protective device.

9. the invention in accordance with claim 7 wherein vertical adjustment between the trochanter pad and the iliac pad is facilitated by shifting of the relative positioning of the mating Velcro type fastener means on the trochanter strap and the trochanter pad.

10. The invention in accordance with claim 9 wherein the trochanter pad, iliac pad, and belt are shiftable with respect to one another so as to permit adjustment therebetween either before or during the wearing by an athlete.

11. The invention in accordance with claim 9 wherein vertical adjustment means between the trochanter pad and the iliac pad is facilitated by shifting of the relative positioning of the mating Velcro type fastener means on the trochanter strap and the trochanter pad.

12. The invention in accordance with claim 6 wherein the trochanter pad, iliac pad, and belt are shiftable with respect to one another so as to permit adjustment therebetween either before or during the wearing by an athlete.

13. The invention in accordance with claim 1 wherein each pad assembly is in the range of approximately $\frac{1}{4}$ inch to $\frac{3}{8}$ inch thick and the hip pad assembly is designed for use by a volleyball player.

14. A method for facilitating protection of the hip and and pelvic area of an athlete, comprising; forming a pair of thin lightweight pad assemblies having a resilient outer surface and a configuration facilitating positioning over the hip and iliac crest area of the pelvis on the respective sides of a user, providing an elongated thin lightweight belt having an elastic portion and velcro type fastener elements at its free ends, removably coupling the belt and pad assemblies in a manner that facilitates relative sliding therebetween and the pad assemblies being separate and movable with respect to one another, dimensioning the Velcro type fastener elements to facilitate attachment therebetween over a range of points thereby making the assembly adjustable to fit a variety of different size atheletes and to be quickly and efficiently put on and removed by the athlete before, during and subsequent to an athletic event, and selective shifting of the belt and pad assemblies relative to one another to facilitate comfortable use by the athlete while accommodating a variety of different athletic movements, forming each pad assembly in a substantially T-shaped configuration and including a horizontally extending iliac pad and a substantially vertically extending trochanter pad depending intermediate the ends of the iliac pad, and affixing a series of receiver elements to each pad through which the belt extends and the belt being formed sufficiently smaller in cross section than receiver elements so as to permit relative sliding movement therebetween, and configurating the iliac pad so that it can be adjustably positioned to cover and protect the iliac crest of the pelvis while the trochanter pad is positioned to cover and protect the greater trochanter of the femur.

15. The invention in accordance with claim 14 wherein one fastener element of the Velcro fastener means is formed as an elongated strip extending from one free end of the belt and the mating fastener element is formed on the other free end of the belt whereby attachment of the elongated strip of the one fastener element to the mating fastener element at different points along the length of the one fastener element provides for adjustment of the length of the circumference and diameter of the hip pad assembly.

16. The invention in accordance with claim 14 wherein one of the fastener elements of said Velcro type fastener means is formed narrower than the mating fastener elements so as to increase the adjustability of the assembly by providing for transverse adjustment as well as circumferential adjustment.

17. The invention in accordance with claim 14 wherein having a series of loops are affixed to each pad through which the belt extends and the belt is formed sufficiently smaller in cross-section than the loops so as to prevent relative sliding movement therebetween.

18. The invention in accordance with claim 14 wherein two pad assemblies are formed, one for each hip of the user, each pad assembly is substantially T-shaped in configuration and includes a horizontally extending iliac pad and a substantially vertically extending trochanter pad depending intermediate in the ends of the iliac pad, and the loops being affixed to the iliac pad and being in spaced parallel relationship to one another, and the iliac pad having a predetermined configuration and size to be positioned to cover and protect the iliac crest of the pelvis while the trochanter pad is positioned to cover and protect the greater trochanter of the femur.

19. The invention in accordance with claim 14 wherein each pad assembly is in the range of approximately $\frac{1}{4}$ inch to $\frac{3}{8}$ inch thick and the hip pad assembly is designed for use by volleyball player.

20. The invention in accordance with claim 14 wherein the trochanter pad is removably attached to the iliac pad.

21. The invention in accordance with claim 14 wherein the trochanter pad includes a trochanter adjustment strap extending from one end thereof, mating Velcro fastener means on the free end of the trochanter adjustment strap and the trochanter pad so that when the trochanter adjustment strap is positioned around the iliac pad and the Velcro type fasteners elements are interengaged, the trochanter pad will be attached to the iliac pad and together form a T-shaped configuration, the trochanter adjustment strap having a predetermined length and the Velcro type fastener elements on the trochanter strap and the trochanter pad being dimensioned so as to prevent vertical adjustment of the trochanter pad with respect to the iliac pad and to provide freedom of movement between the iliac pad, the trochanter pad and the belt.

22. The invention in accordance with claim 14 wherein release of the Velcro type fastener means on the trochanter adjustment strap and the trochanter pad will permit removal of the trochanter pad from the iliac pad and the iliac pad being capable of use independent of the trochanter pad as a protective device.

* * * * *